US005134938A

United States Patent [19]

Büsse et al.

[11] Patent Number: 5,134,938

[45] Date of Patent: Aug. 4, 1992

[54] SHEET FEEDING UNIT FOR ROTARY PRINTING MACHINE

[75] Inventors: Winfried Büsse; Gunter Peter, both of Radebeul; Otfried Rudolph, Dresden; Arndt Jentzsch, Coswig, all of Fed. Rep. of Germany

[73] Assignee: KBA Planeta AG, Radebeul, Fed. Rep. of Germany

[21] Appl. No.: 764,140

[22] Filed: Sep. 20, 1991

[30] Foreign Application Priority Data

Sep. 22, 1990 [DE] Fed. Rep. of Germany ..... 4030070

[51] Int. Cl.[5] ..... B41F 5/02; B41F 21/06; B41F 21/10; B41L 21/08

[52] U.S. Cl. ..... 101/230; 101/411

[58] Field of Search ..... 101/230, 231, 232, 246, 101/183, 184, 177, 409, 410, 411, 475; 271/82, 194, 195, 196, 197, 902, 184, 185, 186, 187, 225, 69

[56] References Cited

U.S. PATENT DOCUMENTS

| | | | |
|---|---|---|---|
| 3,884,146 | 5/1975 | Ruetschle | 101/183 |
| 4,099,463 | 7/1978 | Zimmermann | 101/232 |
| 4,535,691 | 8/1985 | Kida | 101/230 |

FOREIGN PATENT DOCUMENTS

| | | | |
|---|---|---|---|
| 104343 | 8/1917 | United Kingdom | 101/232 |

*Primary Examiner*—J. Reed Fisher
*Attorney, Agent, or Firm*—Michael J. Striker

[57] ABSTRACT

A sheet feeding unit for a rotary sheet printing machine which is operative for selective face printing or face and back printing with turning of a sheet rear edge and which has a turning cylinder and a printing cylinder located before the turning cylinder, includes elements located underneath the turning drum and the printing drum for conducting and guiding overlong sheets in face and back printing during a turning step on a front edge. The elements include a suction member arranged rotatably over a circular path so as to take over a sheet in a point of intersection of tangent $t_5$, a stationary segment arch arranged equidistantly relative to the circular path under a point of intersection $T_{4,5}$ of the printing cylinder and a sheet guiding cylinder and also provided with guiding rollers, and a guiding plate located above a turning point of the suction member at a distance from the printing cylinder and inside the circular path over a line of a secante.

3 Claims, 1 Drawing Sheet

SHEET FEEDING UNIT FOR ROTARY PRINTING MACHINE

BACKGROUND OF THE INVENTION

The present invention relates to a sheet feeding unit for sheet rotary printing machines.

More particularly, it relates to a sheet feeding unit for sheet rotary printing machines which selectively is used for face printing or face and back printing, and in which the sheets during the face and back printing can be turned in accordance with the principle of the sheet rear edge turning, and in which devices are arranged under a printing cylinder located before a turning cylinder, to conduct and to guide the sheet on the front edge in face and back printing during the turning step.

Such devices for guiding and conducting of the sheet front edge which after the sheet turning in the face and back printing becomes a rear edge are known, for example from the German Pat. No. DD-PS 101,336. This reference shows in FIG. 1 a guiding device arranged underneath the printing cylinder and including a gripper system which performs one revolution. The gripper system is formed as a cam-driven double rocker with the gripper arranged on the connecting rod. A second gripper system is provided on the printing cylinder. This gripper system includes a cam-driven double rocker with the gripper abutment articulately connected to the connecting rod. In addition, a guiding passage is provided, which is composed of two conducting elements having a constant distance from one another. Air can be blown in the guiding passage through conductor elements to carry the sheets.

The above described device has the disadvantage in that it involves high technical expenses resulting from two auxiliary gripper systems as well as the guidance of the sheet end on a connecting rod cam. By guiding the sheet end on a connecting rod curve it is moved discontinuously. Thereby it can lead to compressions of the sheet and therefore to its contact with the conducting element. This contact can lead to a smudging of the printed downwardly facing surfaces.

SUMMARY OF THE INVENTION

Accordingly, it is an object of the present invention to provide a sheet feeding unit for a rotary printing machine which avoids the disadvantages of the prior art.

More particularly, it is an object of the present invention to provide a sheet printing unit for a rotary printing machine, which can be produced with low technical expenses and which avoids a smudging of the sheets.

In keeping with these objects and with others which will become apparent hereinafter, one feature of the present invention resides, briefly stated, in a sheet feeding unit which has a suction member rotatable over a circular path and taking over a sheet in point of intersection of tangent $t_s$, a stationary segment arch arranged equidistantly to the circular path under a point of intersection of tangents of the printing cylinder and sheet guiding cylinder and provided with guiding rollers, and a guiding plate located over a turning point of the suction member at a distance from the printing cylinder inside the circular path over the line of a secante.

When the sheet feeding device is designed in accordance with the present invention it avoids the disadvantages of the prior art and provides for the above mentioned highly advantageous results.

Also, the sheet feeding device in accordance with the present invention operates so that over-long sheets can be guided and conducted during a turning step without forming a sheet pile.

The inventive sheet feeding unit has the advantage that due to the movement of the suction member over a circular path the sheet is reliably conducted and guided on the front edge, and therefore the formation of a sheet pile is prevented. Due to this fact, the smudge free turning of the sheet is guaranteed.

In accordance with another feature of the present invention, the holding force of the suction member of the sheet feeding unit is smaller than the holding force of the suction system of the turning drum. Therefore, the sheet can be pulled from the suction member without turning off the suction air. As a result, a changing over the suction air during processing of another sheet length is not required.

In an advantageous manner, the sheet is conducted by the segment arch with the guiding rollers arranged equidistantly to the circular path. Therefore the segment arch and the suction member take over the conducting and guiding functions in the phase before the movement reverse of the sheet, while the guiding plate performs this function after the movement reverse.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

Figure 1:
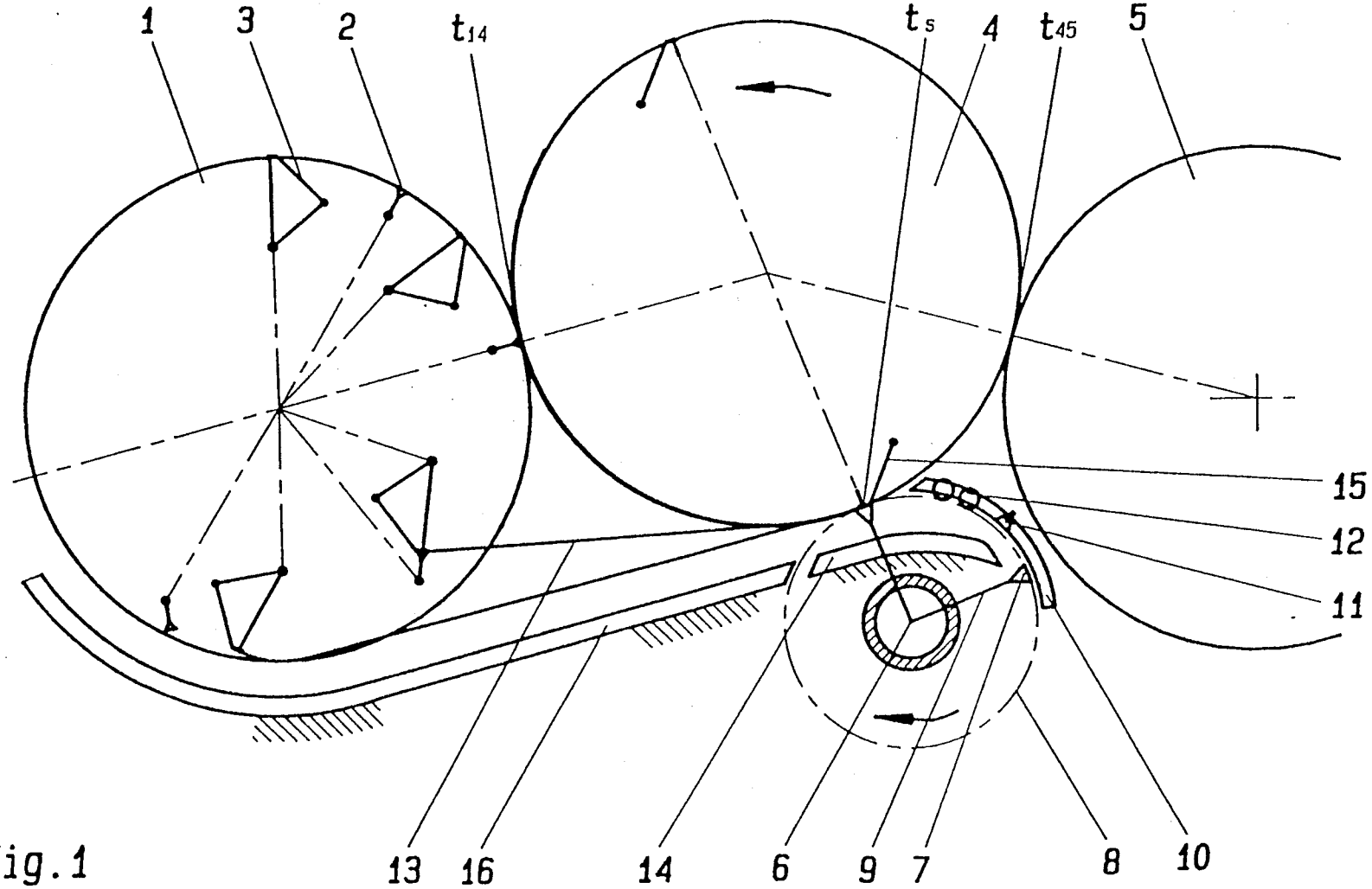
FIG. 1 is a view shematically showing a face and back printing device with a sheet feeding unit in accordance with the present invention.

FIG. 1 shows schematically a face and back printing device with a sheet storage unit. The face and back printing device includes a turning drum 1 which has two oppositely located correlatively cooperating suction and gripper systems 2 and 3 as disclosed for example in the German document DD-PS 54,703.

A printing cylinder 4 is located before the turning cylinder 1, and a sheet guiding cylinder 5 is located near the printing cylinder 4. The printing cylinder 4 and the sheet guiding cylinder 5 are in contact with one another in a point of intersection of tangents $t_{4,5}$. The turning cylinder 1 has a common point of intersection of tangent $t_{1,4}$ with the printing cylinder 4. Rubber and plate cylinders associated with the printing cylinder 4 are not shown in the drawings.

A sheet feeding unit in accordance with the present invention is located underneath the printing cylinder 4. The sheet feeding unit has the following construction.

A suction member 7 is supported in a turning point 6 on a supporting frame 9. The suction member 7 is driven over a circular paths 8 so that it circumferentially performs a single revolution. The circular path 8 contacts the printing cylinder 4 in a point of intersection of tangent $t_s$. Similar suction members 7, for example at least two suction members, can be provided over the width of the printing cylinder 4. Instead of the suction member 7 also a gripper can be provided.

A segment arch 10 is provided equidistantly to the circular path 8 under the printing cylinder 4 and the sheet guiding cylinder 5. The segment arch 10 is formed box-shaped and has suction openings 11 and guiding rollers 12 for conducting and guiding a sheet 13.

A guiding plate 14 is fixedly arranged inside the circular path 8 covered by the suction member 7. It is located between the turning point 6 and the printing cylinder 4. The guiding plate 14 lies inside the circular path 8 on the line of a secante. It is also possible to form the guiding plate 14 box-shaped and act on it pneumatically with blowing air. In this case openings are provided in the guiding plate 14.

A guiding element 16 is fixedly arranged under the printing cylinder 4 up to the area limited by the circular path 8, and also under the turning cylinder 1. The guiding element 16 is known and does not constitute a novelty of the present invention.

The sheet feeding unit according to the present invention operates in the following manner:

The sheet feeding unit is not operative in the mode of face printing. Instead it is operative only in the mode of face and back printing during processing of the sheet 13 having a length which is greater than the length of the circular arc of the printing cylinder 4 from the point of intersection of tangent $t_{1,3}$ to the point of intersection of tangent $t_{4,5}$.

During the operation in the mode face and back printing the sheet 3 in a known manner is guided with its front edge over the point of intersection tagent $t_{1,4}$ of the printing cylinder 4 and the turning cylinder 1 to the point of intersection tangent $t_s$, where for preventing the entering in the point of intersection of tangent $t_{4,5}$ of the printing cylinder 4 and the sheet guiding cylinder 4 it is taken over by the suction member 7. Then it is guided over the circular path 8 against the segment arch 10 or its guiding rollers 12. The sheet is subjected to a movement reverse in which the previous rear edge becomes front edge, and it falls with its part lying over the guiding plate 14 against the guiding plate. There due to blowing air exiting from the guiding plate 14 it is held in a suspended condition. When the sheet 13 passes with its sheet edge the gap between the guiding plate 14 and the guiding element 16, the suction member 7 for taking over of the next sheet 13 can circle back to the point of intersection of tangent $t_s$ to take over the next sheet 13.

This suction air in the suction member 7 is selected so that the total suction force is smaller than the total suction force of the suction system 2 of the turning cylinder 1. Therefore the sheet 13 during the movement reverse can be pulled over the suction member 7 without turning off the suction air. Thereby it is not required during processing of different sheet lengths, with respect to the turning angle of the suction member 7, to provide a change concerning the turning off of the suction air.

It will be understood that each of the elements described above, or two or more together, may also find a useful application in other types of constructions differing from the types described above.

While the invention has been illustrated and described as embodied in a suction sheet feeding unit for a rotary sheet printing machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A sheet feeding unit for a rotary sheet printing machine which is operative for selective face printing or face and back printing with turning of a sheet rear edge and which has a turning cylinder and a printing cylinder located before the turning cylinder, a sheet storage unit comprising a means located underneath the turning drum and the printing drum for conducting and guiding overlong sheets in face and back printing during a turning step on a front edge, said means including a suction member arranged rotatably over a circular path so as to take over a sheet in a point of intersection of tangent ($t_s$), a stationary segment arch arranged equidistantly relative to said circular path under a point of intersection ($t_{4,5}$) of the printing cylinder and a sheet guiding cylinder, said segment arch being provided with guiding rollers; and a guiding plate located above a turning point of said suction member at a distance from the printing cylinder and inside said circular path over a line of a secante.

2. A sheet feeding unit as defined in claim 1, wherein said means further has a supporting arm, said suction member being arranged on said supporting arm.

3. A sheet feeding unit as defined in claim 1, wherein said turning drum has a suction system with a predetermined total suction force, said suction member being selected so that its total suction force is smaller than the total suction force of the suction system of the turning drum.

* * * * *